US005706774A

United States Patent [19]

Shaw

[11] Patent Number: 5,706,774

[45] Date of Patent: Jan. 13, 1998

[54] CARBURETOR START PUMP CIRCUIT

[75] Inventor: Scott R. Shaw, Nashville, Tenn.

[73] Assignee: U.S.A. Zama, Inc., Franklin, Tenn.

[21] Appl. No.: 653,679

[22] Filed: May 24, 1996

[51] Int. Cl.[6] ..... F02M 1/16

[52] U.S. Cl. ..... 123/179.11; 123/179.14; 123/DIG. 5; 261/35

[58] Field of Search ..... 123/179.7, 179.12, 123/179.13, 179.14, 179.15, DIG. 5, 179.11; 261/35

[56] References Cited

U.S. PATENT DOCUMENTS 3,743,254 7/1973 Tuckey ..... 261/35
4,159,012 6/1979 Pizzuto et al. ..... 261/35
4,554,896 11/1985 Sougawa ..... 123/179.15
4,814,114 3/1989 Charmley ..... 261/35
5,150,673 9/1992 Hoshiba et al. ..... 123/179.15

*Primary Examiner*—Andrew M. Dolinar
*Attorney, Agent, or Firm*—Lyon & Lyon LLP

[57] ABSTRACT

A carburetor start pump circuit, for starting an engine, has an auxiliary fuel pump mounted on a relatively standard carburetor body, a pulse passageway extending through the carburetor body to the auxiliary fuel pump, and a fuel circuit having an intake side extending from a metering chamber in the carburetor body to the auxiliary pump where it is interconnected to a discharge side extending from the auxiliary pump to a throttle bore in the air intake of the carburetor body. To facilitate control of fuel flow, the fuel circuit includes inlet and discharge check valves and a metering jet.

28 Claims, 2 Drawing Sheets

CARBURETOR START PUMP CIRCUIT

FIELD OF THE INVENTION

This invention relates to carburetors, and more particularly to an air-fuel mixture enrichment circuit that facilitates engine starting.

BACKGROUND OF THE INVENTION

Most engines require a mixture enrichment system to improve or even allow starting. An enrichment system is especially necessary when the engine is cold, or after the engine has been run out of fuel. The two common means of enrichment in the field of small engines are the choke and the primer.

The choke provides enrichment by closing off the front end of the air intake of a carburetor to allow a manifold vacuum to draw on all of the fuel passages that open to the air intake. The disadvantage of the choke is that the user must close the choke completely and then crank the engine until they hear a false start. The choke is then partially opened and the engine is cranked until it starts. When the engine is warmed up 30 to 40 seconds, the choke is opened fully. This operation is too complex for many users and results in many field returns and complaints.

The primer uses a manually operated bulb to inject fuel into the carburetor throat. The disadvantage of the primer is that a simple primer cannot regulate the amount of fuel injected into the carburetor throat which makes it easy for the user to over- or under-prime the engine, resulting in no start.

Therefore, it would be desirable to have a device that is simple to use, that minimizes the number of steps necessary to start the engine, that does not depend on high manifold vacuums to draw fuel from fuel ports, and that regulates the amount of fuel injected into the carburetor throat to ensure the engine is properly primed.

SUMMARY OF THE INVENTION

The carburetor start pump circuit of the present invention serves to facilitate engine starting in a simple manner that is independent of manifold vacuums and capable of regulating the amount of fuel injected into the carburetor throat to ensure the engine is properly primed. It preferably has an auxiliary fuel pump mounted on a relatively standard carburetor body, a start pulse passage extending through the carburetor body to the auxiliary fuel pump, and a fuel circuit having an intake side which extends from a metering chamber of the carburetor body to the auxiliary fuel pump and a discharge side which is interconnected to the intake side and extends from the auxiliary fuel pump to a throttle bore in the air intake of the carburetor body. The fuel in the fuel circuit is regulated into and out of the auxiliary fuel pump with inlet and discharge check valves and a metering jet.

An object of this invention is to provide an improved carburetor start pump circuit.

Further objects and advantages of the present invention will become apparent from a consideration of the drawings and ensuing description.

DETAILED DESCRIPTION OF THE PREFERRED EMBODIMENT

Figure 1:
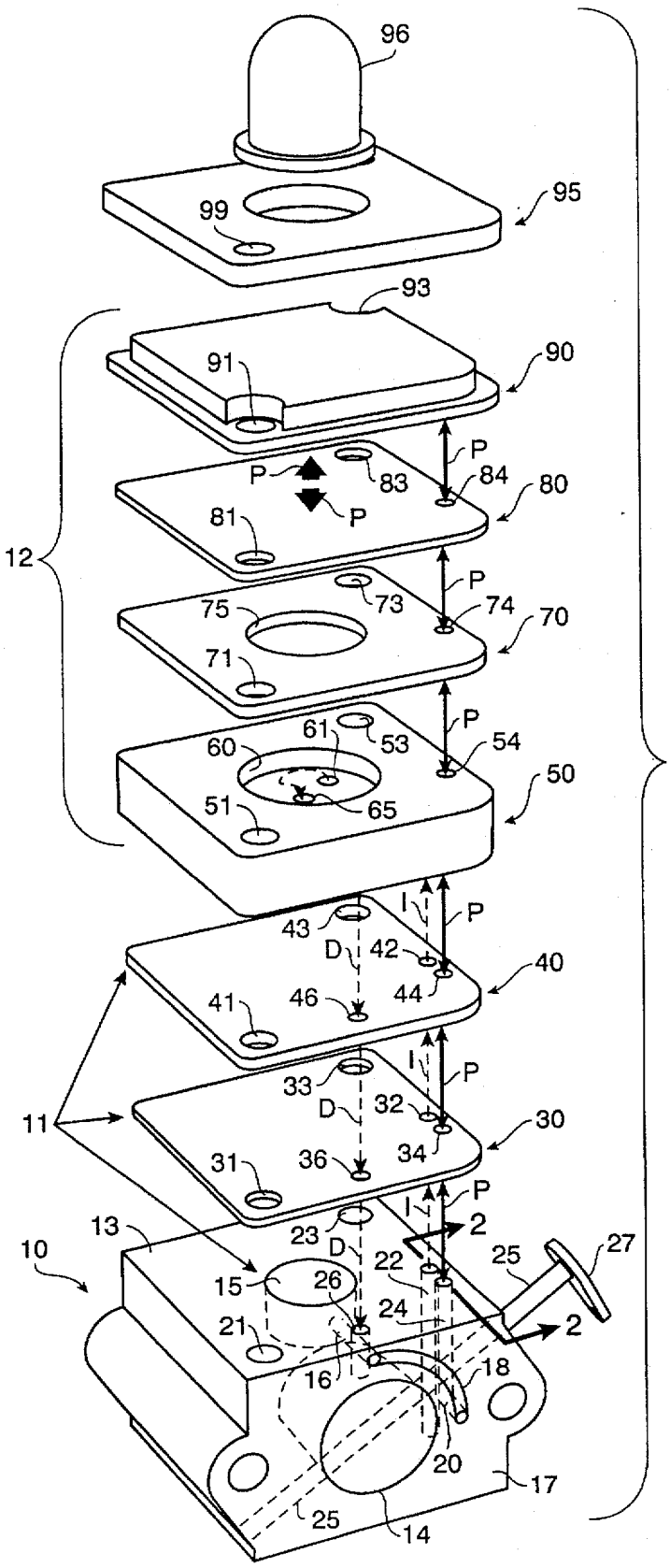
FIG. 1 is an exploded isometric view of a preferred embodiment of a carburetor including the start pump circuit of the present invention.

Referring now in detail to the drawings, therein illustrated is a novel carburetor start pump circuit of the present invention. Turning to FIG. 1, a relatively standard carburetor body 10 includes a main pulse passageway 16 bored into the carburetor body 10 from its face 17. The main pulse passageway 16 opens into a pulse chamber 15 of a main fuel pump 11 bored into the carburetor body 10 from a top surface 13. A starting pulse passageway 20 is also bored into the carburetor body 10 from the face 17. A channel 18, preferably two millimeters wide, is cut into the face 17 of the carburetor body 10. The channel 18 runs from the main pulse passageway 16 to the starting pulse passageway 20 to carry the crankcase pulse to the starting pulse passageway 20. The channel 18 is interconnected to the crank case of an engine at a point adjacent to the main pulse passageway 16. The remainder of the channel 18 is covered by a carburetor mounting gasket (not shown) which interposes the carburetor body 12 and the engine (not shown) when the carburetor is mounted on the engine.

Three passageways are bored into the carburetor body 10 from the top surface 13. The first is a pulse passageway 24 which opens into the starting pulse passageway 20. The second is a fuel intake passageway 22 which opens into the metering chamber (not shown) of the carburetor body 10. The third is a fuel discharge passageway 26 which opens into a throttle bore 14 of the air intake of the carburetor body 10.

Figure 2:
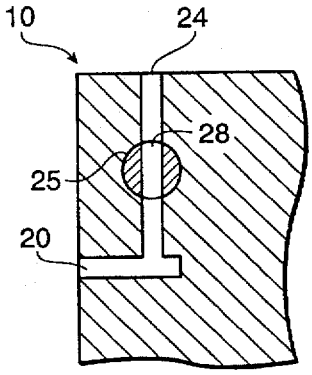
FIG. 2 is a partial cross-sectional view taken along line 2—2 in FIG. 1.
Figure 3:
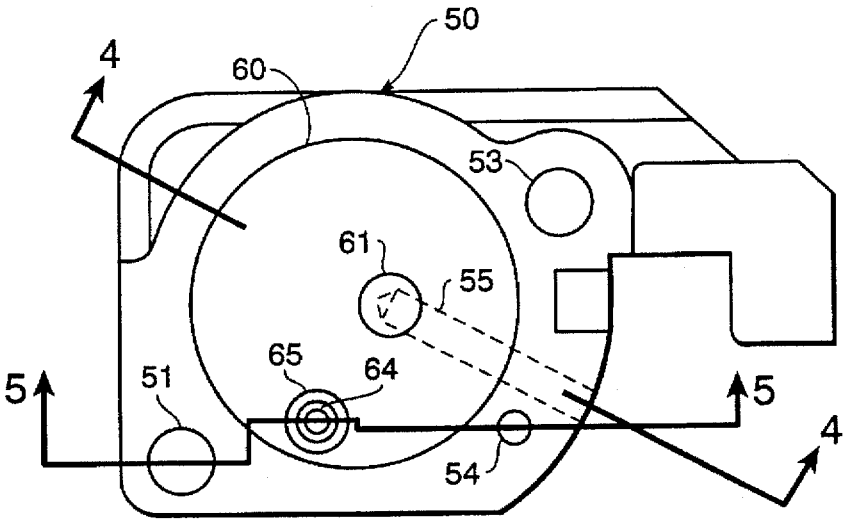
FIG. 3 is a top view of an auxiliary start pump body of the carburetor start pump circuit of the present invention.
Figure 4:
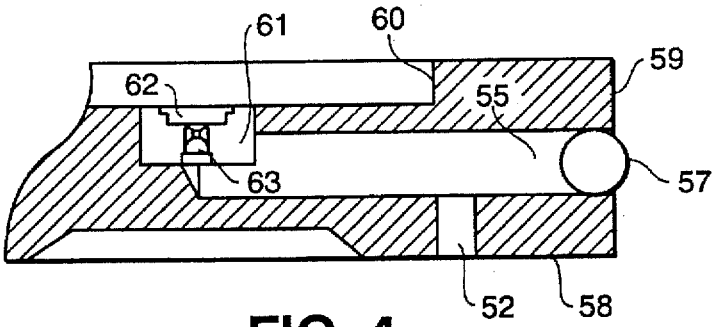
FIG. 4 is a partial cross-sectional view taken along line 4—4 in FIG. 3.
Figure 5:
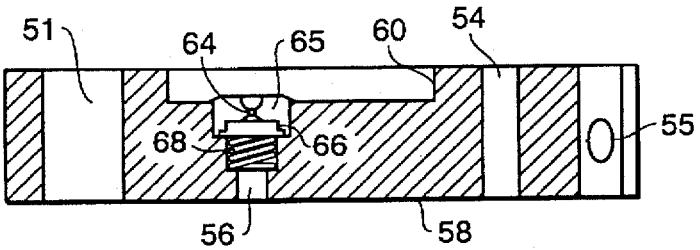
FIG. 5 is a cross-sectional view taken along line 5—5 in FIG. 3.

Referring to FIGS. 1 and 2, the pulse passageway 24 is shown to be operably interconnected to the starting pulse passageway 20 via a passageway 28 drilled through a throttle shaft 25. Thus, passageways 20 and 24 are only in communication with one another when a throttle lever 27 attached to the throttle shaft 25 is positioned in a start position which results in passageway 28 being aligned with passageways 20 and 24.

Turning to FIG. 1, a pair of holes 21 and 23 are tapped into the top surface 13 of the carburetor body 10 and used to mount a main fuel pump 11 and an auxiliary or start fuel pump 12. The main fuel pump 11, which operates in a manner known in the art, includes a flat fuel pump diaphragm 30 mounted on the top surface 13 of the carburetor body 10. The diaphragm 30 interposes the carburetor body 10 and a fuel pump gasket 40. The fuel pump diaphragm 30 includes a pair of holes 31 and 33 that are aligned with holes 21 and 23 in the carburetor body 10 to mount the diaphragm 30 on the carburetor body 10. In addition, the fuel pump diaphragm 30 includes a fuel intake hole 32, a pulse hole 34, and a fuel discharge hole 36. The fuel intake hole 32, the pulse hole 34, and the fuel discharge hole 36, respectively, are aligned with the fuel intake passageway 22, the pulse passageway 24, and the fuel discharge passageway 26, respectively, in the carburetor body 10 when the fuel pump diaphragm 30 is mounted on the top surface 13 of the carburetor body 10.

The fuel pump gasket 40, which mounts on the carburetor body 10 on top of the fuel pump diaphragm 30, also includes a pair of holes 41 and 43 that are aligned with holes 21 and 23 in the carburetor body 10 to mount the gasket 40. The fuel pump gasket 40 also includes a fuel intake hole 42, a pulse hole 44, and a fuel discharge hole 46, respectively, that are aligned with the fuel intake passageway 22, the pulse passageway 24, and the fuel discharge passageway 26, respectively, in the carburetor body 10 when the fuel pump gasket 40 is mounted on the carburetor body 10.

The auxiliary fuel pump 12 includes a pump body 50 mounted on top of the main fuel pump 11, a start pump gasket 70 mounted on top of the start pump body 50, a start pump diaphragm 80 mounted on top of the start pump gasket 70 and a start pump cover 90 mounted on top of the start pump diaphragm 80. Holes 51 and 53 in the start pump body 52, holes 71 and 73 in the start pump gasket 70, holes 81 and 83 in the start pump diaphragm 80, and holes 91 and 93 in the start pump cover 90 are all aligned with the holes 21 and 23 in the carburetor body 10 to mount these components on the carburetor body 10.

The auxiliary pump body 50 as shown in FIGS. 1, 3, 4 and 5 includes a fuel intake passage 52 bored into the fuel pump body 50 from its bottom surface 58. The fuel intake passageway 52 opens into an intake pathway 55 bored into the auxiliary pump body 50 from its side 59. A plug 57 seals one end of the intake pathway 55 adjacent to the side 59 of the pump body 52. The intake pathway 55 directs the fuel from the metering chamber to an inlet check valve 62 seated in an inlet valve chamber 61. The inlet check valve 62 is a simple viton disk that allows fuel to flow into a pumping chamber 60 bored into the auxiliary pump body 50 from its top surface 67, but prevents back flow. The inlet valve chamber 61 is bored into the auxiliary pump body 50 from the pump chamber 60. A calibrated inlet jet 63 may be positioned at the entrance of the inlet check valve 62 to meter the flow of fuel into the pumping chamber 60.

The auxiliary pump body 50 also includes a pulse passageway 54 bored through the auxiliary pump body 50 and a fuel discharge passageway 56 bored into the auxiliary pump body 50 from its bottom surface 58. The pulse passageway 54 is aligned with the pulse passageway 24 in the carburetor body 10 and the fuel discharge passageway 56 is aligned with the fuel discharge passageway 26 in the carburetor body 10. The fuel discharge passageway 56 opens to a discharge check valve chamber 65 bored into the auxiliary pump body 50 from the pumping chamber 60. A discharge check valve 66 is mounted in the valve chamber 65. The discharge check valve 66 is held close against its seat by a spring 68 positioned on the discharge side of the check valve 66. The spring force prevents fuel from being drawn out of the system by the carburetor manifold vacuum when the start pump 12 is shut off, i.e., when the throttle shaft 25 is rotated out of the start position and passageway 28 is no longer aligned with passageways 20 and 24. A calibrated jet 64 may be positioned on the inlet side of the discharge check valve 66. The calibrated jets 63 and 64 restrict the fuel flow into the engine to prevent an overrich condition at startup.

The auxiliary pump gasket 70 maintains a seal between the auxiliary pump body 50 and the auxiliary pump diaphragm 80. The gasket 70 includes a pulse hole 74 aligned with the pulse passageway 24 in the carburetor body 10 and a hole 75 aligned with the pumping chamber 60 in the auxiliary pump body 50 to allow the auxiliary pump diaphragm 80 to communicate with the pumping chamber 60.

The auxiliary pump diaphragm 80 transfers the force of the crank case pulse to the fuel in the pumping chamber 60 of the auxiliary pump body 50. The flat auxiliary pump diaphragm 80 includes a pulse hole 84 aligned with the pulse passageway 24 in the carburetor body 10.

The pump cover 90, which seals the stack of gaskets 40 and 70, diaphragms 30 and 80, and the auxiliary pump body 52, accepts the crank case pulse P and directs it to the auxiliary pump diaphragm 80.

In operation, the start pump 10 is activated by turning on the crank case pulse supplied to it. The crank case pulse P can be controlled with the throttle shaft as shown in FIG. 1, or by some other means such as a choke shaft or some other valve. The preferred embodiment as shown in FIGS. 1 and 2 includes a hole 28 drilled through the throttle shaft 25. When the throttle shaft 25 is rotated past wide open throttle to a preset position, the hole 28 in the throttle shaft 25 aligns with passageways 20 and 24 in the carburetor body 10 and the pulse P is allowed to enter the start pump 12. This control configuration ensures that the start pump 12 only feeds fuel to the engine during start-up.

The pulse P travels up through the stack of the main fuel pump diaphragm 30 and the main fuel pump gasket 40, and then through the auxiliary pump body 52, diaphragm 80, and gasket 70 and on into the start pump cover 90. The pulse P moves the diaphragm 80 up and down which creates a corresponding vacuum and pressure in the pumping chamber 60 of the auxiliary pump body 50. The vacuum pulse opens the inlet check valve 62 and draws fuel I from the metering chamber (not shown) of the carburetor body 10. By drawing fuel from the metering chamber, the carburetor start pump circuit advantageously acts as an air purge or primer.

The fuel I passes through the carburetor body 10 through the main fuel pump diaphragm 30 and gasket 40, into the start pump body 50 and on into the pumping chamber 60 through the inlet check valve 62 and, optionally, through the calibrated metering jet 63. When the auxiliary pump diaphragm 80 is pushed down into the auxiliary pump body 50 by the crank case pulse P, the inlet check valve 62 is forced closed and the force of the crank case pulse P is transferred to the fuel forcing the fuel through the discharge check valve 66 and, optionally, first through the calibrated metering jet 64. The fuel must pass through the starting jet 64 and press open the spring 68 loaded check valve 66 to leave the pumping chamber 60. The spring 68 exerts a sufficient force on the check valve 66 to prevent it from being opened by a manifold vacuum and thus ensuring that fuel is not drawn through the carburetor start pump circuit unless the start pump 12 is receiving a pulse P.

The fuel D then exits the auxiliary pump body 50 through the discharge fuel passageway 56 and passes back through the main pump gasket 40 and diaphragm 30, and on through the fuel discharge passageway 26 into the throttle bore 14 in the carburetor body 10. When the engine is warmed up, the operator shuts off the start pump circuit and the engine begins normal operation.

In an alternative embodiment (see FIG. 1), the carburetor start pump circuit of the present invention would include a primer having a pump body 95 and a primer bulb 96. The primer is mounted to the carburetor body using a pair of holes 95 and operates in a manner known in the art.

Thus, the carburetor start pump circuit of the present invention provides many benefits over the prior art. While the above description contains many specificities, these should not be construed as limitations on the scope of the invention, but rather as an exemplification of one preferred embodiment thereof. Many other variations are possible.

Accordingly, the scope of the present invention should be determined not by the embodiments illustrated above, but by the appended claims and their legal equivalents.

What is claimed is:

1. A carburetor comprising a body, a first fuel pump mounted on said body, a starter circuit including a second fuel pump mounted on said body, and a first pulse passageway extending through said body to said second fuel pump.

2. The carburetor of claim 1, wherein said second fuel pump is only operational during engine start-up.

3. The carburetor of claim 1, wherein said starter circuit further comprises a first fuel passageway interconnecting said second fuel pump to a metering chamber in said body, and a second fuel passageway interconnecting said second fuel pump to a throttle bore in said body.

4. The carburetor of claim 3, wherein said starter circuit includes a check valve interposing said first fuel passageway and a pumping chamber in said second fuel pump.

5. The carburetor of claim 3, wherein said starter circuit includes a check valve interposing said discharge fuel passageway and a pumping chamber in said second fuel pump.

6. The carburetor of claim 5, wherein said outlet check valve is spring loaded.

7. The carburetor of claim 1, wherein said starter circuit comprises a metering jet.

8. The carburetor of claim 1, further comprising a second pulse passageway extending through said body to said first fuel pump, and a channel interconnecting said first and second pulse passageways.

9. The carburetor of claim 1, wherein said second fuel pump includes a diaphragm.

10. The carburetor of claim 1 wherein said first pulse passageway has an open mode during engine start-up and a closed mode during all other modes of engine operation.

11. The carburetor of claim 1 further comprising a primer bulb interconnected to said second fuel pump.

12. A carburetor comprising a body, a start circuit including a fuel pump mounted on said body and driven by a pulse from an engine's crankcase during start-up of an engine, a pulse passageway extending through said body to said fuel pump, a first fuel passageway operably interconnecting said fuel pump to a metering chamber in said body, and a second fuel passageway operably interconnecting said fuel pump to a throttle bore in said body.

13. The carburetor of claim 12, further comprising a second fuel pump mounted on said body.

14. The carburetor of claim 13, further comprising a second pulse passageway extending through said body to said second fuel pump.

15. The carburetor of claim 14, wherein said pulse passageway is interconnected to said second pulse passageway.

16. A carburetor comprising a body, a first fuel pump mounted on said body, and a second fuel pump mounted on said body, said second fuel pump being operably interconnected to an engine's crankcase during engine start-up when said body is mounted to an engine.

17. The carburetor of claim 16 further comprising a pulse passageway extending through said body to said second fuel pump.

18. The carburetor of claim 17 wherein said pulse passageway includes a valve member mounted in said passageway.

19. The carburetor of claim 18 wherein said valve member is positionable to a preset engine start-up position wherein said pulse passageway is open.

20. The carburetor of claim 19 wherein said valve member comprises a throttle valve shaft having a hole drilled therethrough, said hole being aligned with said pulse passageway when said throttle valve shaft is rotated to a preset engine start-up position.

21. The carburetor of claim 17 further comprising a first fuel passageway operably interconnecting said second fuel pump to a metering chamber in said body, and a second fuel passageway operably interconnecting said second fuel pump to a throttle bore in said body.

22. A method of enriching the air-fuel mixture in a carburetor mounted to an engine during start-up of the engine comprising the steps of transmitting a pulse from an engine's crankcase to an auxiliary fuel pump mounted on a carburetor body, drawing fuel from a metering chamber in the carburetor body into a pumping chamber of the auxiliary fuel pump, discharging the fuel in the pumping chamber in the auxiliary fuel pump into a throttle bore in the carburetor body, and terminating the transmission of the pulse from the engine's crankcase after the engine has reached a desired operating temperature.

23. The method of claim 22 further comprising the steps of opening a pulse passageway in the carburetor body that is interconnected to the auxiliary pump and the engine's crankcase, and closing the pulse passageway after the engine has reached a desired operating temperature.

24. The method of claim 23 further comprising the step of rotating a throttle valve shaft in the carburetor past wide open throttle to a preset position wherein a hole drilled through the throttle valve shaft is aligned with the pulse passageway to open the pulse passageway, and reverse rotating the throttle valve shaft to close the pulse passageway.

25. The method of claim 22 further comprising the step of metering the fuel into the auxiliary pump.

26. The method of claim 22 further comprising the step of metering the fuel out of the auxiliary pump.

27. The method of claim 22 further comprising the step of priming the auxiliary fuel pump with fuel.

28. The method of claim 22 further comprising the step of purging air from the metering chamber in the carburetor body.

* * * * *

UNITED STATES PATENT AND TRADEMARK OFFICE

CERTIFICATE OF CORRECTION

PATENT NO. : 5,706,774

DATED : January 13, 1998

INVENTOR(S) : Scott R. Shaw

It is certified that error appears in the above-identified patent and that said Letters Patent is hereby corrected as shown below:

Column 5, line 65, after "being" insert --selectively--.

Column 6, line 1, change "during" to --for--.

Column 6, line 29, after "body" insert --for engine start-up--.

Column 6, line 38-39, change "reached a desired operating temperature" to --warmed up--.

Column 6, line 45-46, change "reached a desired operating temperature" to --warmed up--.

Signed and Sealed this

Twenty-sixth Day of May, 1998

*Attest:*

*Attesting Officer*

BRUCE LEHMAN

*Commissioner of Patents and Trademarks*